US009877109B2

(12) United States Patent
Kajihara et al.

(10) Patent No.: US 9,877,109 B2
(45) Date of Patent: Jan. 23, 2018

(54) DIAPHRAGM FOR LOUDSPEAKER, LOUDSPEAKER, ELECTRONIC APPARATUS, AND MOBILE APPARATUS

(71) Applicant: Panasonic Intellectual Property Management Co., Ltd., Osaka (JP)

(72) Inventors: Yoshimichi Kajihara, Okayama (JP); Yohei Jin, Mie (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 72 days.

(21) Appl. No.: 14/893,056

(22) PCT Filed: Jul. 17, 2014

(86) PCT No.: PCT/JP2014/003795
§ 371 (c)(1),
(2) Date: Nov. 21, 2015

(87) PCT Pub. No.: WO2015/015742
PCT Pub. Date: Feb. 5, 2015

(65) Prior Publication Data

US 2016/0134971 A1 May 12, 2016

(30) Foreign Application Priority Data

Aug. 1, 2013 (JP) ..... 2013-160087

(51) Int. Cl.

| | |
|---|---|
| ***H04R 7/06*** | (2006.01) |
| ***H04R 7/18*** | (2006.01) |
| ***H04R 31/00*** | (2006.01) |
| ***H04R 9/02*** | (2006.01) |

(52) U.S. Cl.
CPC ..... *H04R 7/06* (2013.01); *H04R 7/18* (2013.01); *H04R 9/025* (2013.01); *H04R 31/003* (2013.01); *H04R 2307/023* (2013.01); *H04R 2307/029* (2013.01)

(58) Field of Classification Search
CPC ..... H04R 7/12
See application file for complete search history.

(56) References Cited

U.S. PATENT DOCUMENTS

| | | | | |
|---|---|---|---|---|
| 2008/0124566 | A1* | 5/2008 | Smallman | C22C 26/00 428/606 |
| 2011/0007922 | A1* | 1/2011 | Jin | C08L 67/04 381/345 |
| 2013/0301867 | A1 | 11/2013 | Jin et al. | |

FOREIGN PATENT DOCUMENTS

| | | |
|---|---|---|
| JP | 4-167900 | 6/1992 |
| JP | 5-328485 | 12/1993 |
| JP | 2006-013657 | 1/2006 |
| JP | 2010-147526 | 7/2010 |
| JP | 2010147526 A * | 7/2010 |
| JP | 2012-227582 | 11/2012 |

OTHER PUBLICATIONS

International Search Report of PCT application No. PCT/JP2014/003795 dated Sep. 2, 2014.

* cited by examiner

*Primary Examiner* — Duc Nguyen
*Assistant Examiner* — Phan Le
(74) *Attorney, Agent, or Firm* — McDermott Will & Emery LLP

(57) ABSTRACT

A diaphragm for loudspeaker contains resin and single-crystal diamond powder dispersed in the resin.

17 Claims, 4 Drawing Sheets

DIAPHRAGM FOR LOUDSPEAKER, LOUDSPEAKER, ELECTRONIC APPARATUS, AND MOBILE APPARATUS

TECHNICAL FIELD

The present invention relates to diaphragms for loudspeakers and loudspeakers employed in a range of audio equipment and video equipment, and electronic apparatus such as stereo sets and television sets, and mobile apparatus.

BACKGROUND ART

Conventionally, some of loudspeakers employ diaphragms formed of a resin material and additive. In general, polypropylene resin is adopted as the resin material. In this case, an inorganic filler such as mica is mixed as the additive to increase rigidity of the diaphragm. As for the additive, for example, berylium, aluminum, talc, calcium carbonate, and paper pulp can be used other than mica. To satisfy required characteristics of the diaphragm, one or more of them are preferably combined and added to the resin.

The diaphragm is fabricated using a general resin molding method. Consequently, the additive is dispersed in the resin.

Known patent literatures related to the present invention include PTL1 and PTL2.

CITATION LIST

Patent Literature

PTL 1: Unexamined Japanese Patent Publication No. 2006-13657

PTL 2: Unexamined Japanese Patent Publication No. H4-167900

SUMMARY OF THE INVENTION

A diaphragm for loudspeaker of the present invention includes resin and single-crystal diamond powder. The single-crystal diamond powder includes first powder. A particle diameter of this first powder is not less than 30 μm and not greater than 60 μm. The first powder accounts for 80% or more by volume ratio in the entire powder.

The single-crystal diamond powder contained in the diaphragm for loudspeaker of the present invention has high rigidity. In other words, rigidity of the diaphragm for loudspeaker can be increased just by adding a small amount of the powder to the resin of the diaphragm for loudspeaker. Accordingly, an amount of the single-crystal diamond powder added to the resin can be suppressed. An increase in weight of the diaphragm can thus be suppressed.

DESCRIPTION OF EMBODIMENTS

Prior to describing an exemplary embodiment of the present invention, a disadvantage in a conventional diaphragm for loudspeaker is described. The additive used in the conventional diaphragm is highly rigid but its specific gravity is large. The more the amount of such additive, the higher the rigidity (high elastic modulus) of the diaphragm becomes. However, a specific gravity of the diaphragm will also increase and the diaphragm becomes heavy. In addition, since the conventional diaphragm needs a large amount of additive, its internal loss becomes small. The conventional diaphragm is therefore difficult to achieve both high rigidity and large internal loss when the diaphragm is particularly for a mid- and low-range loudspeaker having a large-diameter (8 cm or more). To solve the above disadvantage, the present invention offers a diaphragm with both high rigidity and large internal loss.

Figure 1:
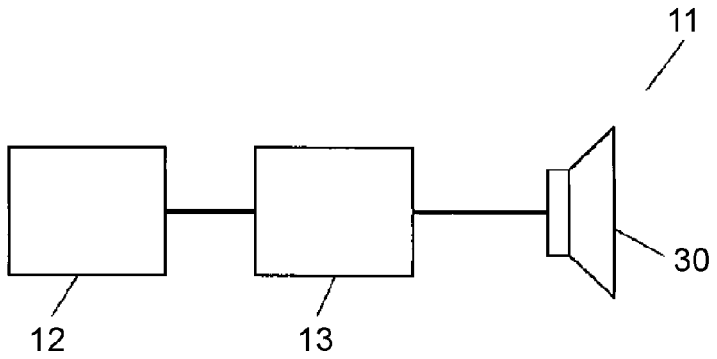
FIG. 1 is a block diagram of an electronic apparatus in accordance with an exemplary embodiment of the present invention.

FIG. 1 is a block diagram of an electronic apparatus in accordance with the exemplary embodiment. Electronic apparatus 11 includes sound source section 12, processor 13, and loudspeaker 30. Electronic apparatus 11 is, for example, audio equipment or video equipment. Sound source section 12 generates a sound source signal. Processor 13 is electrically connected to the output side of sound source section 12. Processor 13 amplifies the sound source signal, and outputs an audio signal. Loudspeaker 30 is electrically connected to the output side of processor 13. Loudspeaker 30 converts the audio signal to sound, and outputs the sound.

In line with recent advancement of digital processing technology, the use of digitalized sound source signals has become widespread. As a result, distortion of a sound output from electronic apparatus 11 is reduced, and a reproduction band and a dynamic range are broad. Thus, electronic apparatus 11 can now output more real sound. On the other hand, an audio signal is an analog signal. Therefore, if the sound source signal is a digital signal, processor 13 converts the sound source signal to the analog signal to output. Electronic apparatus 11 is demanded to reproduce the sound source signal with fidelity. Loudspeaker 30 is thus also demanded to have a wide reproduction band and to reproduce the sound source with fidelity.

Figure 2:
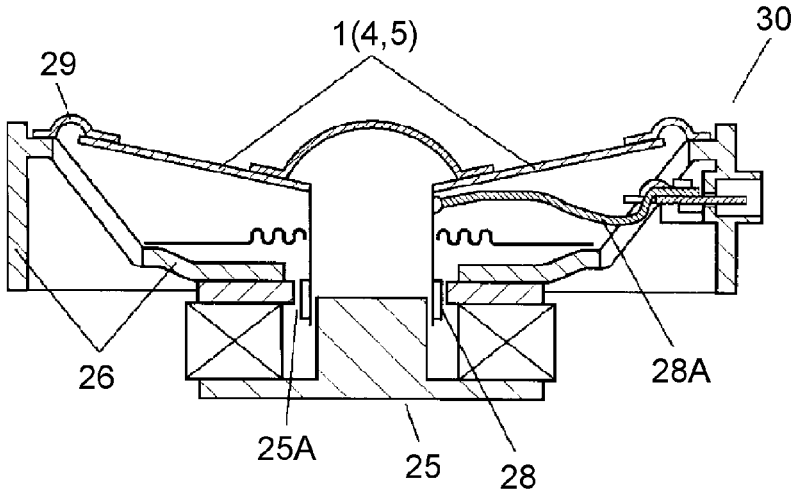
FIG. 2 is a sectional view of a loudspeaker in accordance with the exemplary embodiment of the present invention.

Next, loudspeaker 30 in the exemplary embodiment is described with reference to a drawing. FIG. 2 is a sectional view of loudspeaker 30. Loudspeaker 30 includes frame 26, magnetic circuit 25 having magnetic gap 25A, diaphragm 1 for loudspeaker (hereafter referred to as diaphragm 1), edge 29, and voice coil 28. Loudspeaker 30 may also include tinsel wire 28A. Tinsel wire 28A is electrically connected to voice coil 28. Tinsel wire 28A typically includes a yarn and copper foil. The yarn is disposed at the core of tinsel wire 8A, and then covered with the copper foil.

Magnetic circuit 25 is connected to the back center of frame 26. Edge 29 is connected to the periphery of diaphragm 1. The outer periphery of edge 29 is connected to the outer rim of frame 26. In other words, the outer periphery of diaphragm 1 is connected to frame 26 via edge 29. On the other hand, the center of diaphragm 1 is connected to one end of voice coil 28. The second end of voice coil 28 is inserted into magnetic gap 25A.

Magnetic circuit 25 may be inner magnet type, outer magnet type, or a combination of inner and outer magnet types. If magnetic circuit 25 is the inner magnet type, magnetic circuit 25 includes a yolk, magnet, and upper plate. In this case, the yoke includes the bottom and side face. The magnet is placed on the bottom, and the upper plate is disposed above the magnet. Magnetic gap 25A is formed between the side face and the upper plate.

If magnetic circuit 25 is the outer magnet type, magnetic circuit 25 includes a magnet having a lower plate and through hole, and an upper plate having a through hole. In addition, a center pole is provided at the center of the lower plate. The center pole protrudes from the lower plate. The magnet is placed on the lower plate. The upper plate is disposed above the magnet. The center pole passes through the through hole in the magnet and the through hole in the upper plate. This configuration forms magnetic gap 25A between the side face of the upper plate and the outer peripheral face of the center pole.

In these components configuring loudspeaker 30, performance of diaphragm 1 has a significant effect on sound quality of loudspeaker 30. Diaphragm 1 is therefore required to reproduce sound with more fidelity in a wide band.

Figure 3:
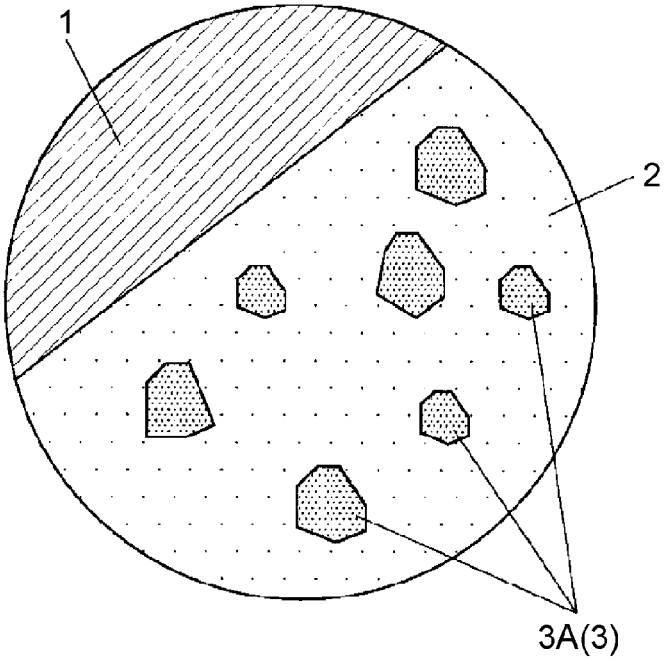
FIG. 3 is a magnified sectional view of a key part of the diaphragm for loudspeaker in accordance with the exemplary embodiment of the present invention.

Hereinafter, diaphragm 1 is detailed with reference to a drawing. FIG. 3 is a magnified sectional view of a key part of the diaphragm in accordance with the exemplary embodiment. As shown in FIG. 3, diaphragm 1 contains resin 2 and single-crystal diamond powder 3 dispersed in resin 2.

Since diaphragm 1 contains resin 2, an internal loss of diaphragm 1 is large. In particular, diaphragm 1 has a small resonance peak in middle and high frequency ranges. As a result, a frequency characteristic of diaphragm 1 is flat, compared to a diaphragm made of paper. The frequency characteristic of diaphragm 1 is thus better than that of the diaphragm made of paper.

Polypropylene is preferably used for resin 2. Polypropylene has a relatively small specific gravity among resin materials that can be used for diaphragm 1, and thus diaphragm 1 can be made light. Polypropylene is crystalline and has a relatively high heat resistance. Polypropylene also has good injection moldability. In addition, polypropylene is generally an easily-available and inexpensive material. Accordingly, the use of polypropylene has a benefit in fabricating diaphragm 1 at low cost. Alternatively, resin 2 may be olefin resin other than polypropylene. For example, resin 2 may be polymethylpentene. Also in this case, diaphragm 1 can be made light.

Resin 2 may also be crystalline resin or non-crystalline resin, depending on the purpose of use of diaphragm 1. This composition can satisfy required characteristics. However, resin 2 is not limited to those described above. For example, resin 2 may be liquid crystal polymer, engineering plastic, or plant-based resin.

As plant-based resin, for example, polylactic resin is used. Diaphragm 1 formed of plant-based resin can contribute to suppression of global environment contamination when it is disposed of in the ground. If engineering plastic is used for resin 2, the heat-resistant temperature of diaphragm 1 increases. Additionally, diaphragm 1 has good resistance with respect to solvents if engineering plastic is used for resin 2.

To make diaphragm 1 satisfy required characteristics, one or a combination of two or more aforementioned resins may be used for resin 2. With this composition, the sound quality of diaphragm 1 can be accurately adjusted. Diaphragm 1 can thus achieve required characteristics and sound quality.

Next is described powder 3. Powder 3 is dispersed in resin 2. Powder 3 contains fine powder 3A, which is first powder of single-crystal diamond. Powder 3 of single-crystal diamond is extremely rigid. Accordingly, the flexural modulus of diaphragm 1 can be increased by adding just a small amount of powder 3 to resin 2. Since only a small amount of powder 3 is sufficient to be added to resin 2, an increase in weight of diaphragm 1 can be suppressed.

This composition enables diaphragm 1 to improve the rigidity and sound velocity thereof, and therefore a reproduction band of diaphragm 1 can be broadened. Distortion of diaphragm 1 can also be reduced. Diaphragm 1 can be easily fabricated by injection molding of a material obtained by kneading resin 2 and powder 3. Accordingly, a man-hour spent for fabricating diaphragm 1 can be reduced, and thus diaphragm 1 can be fabricated at low cost.

Since powder 3 is single-crystal diamond, it has a blocky shape. This shape increases an anchoring effect of powder 3 on resin 2. In other words, powder 3 and resin 2 can be firmly bound together at their boundary faces, and thus an elastic modulus of diaphragm 1 can be increased. The blocky shape of powder 3 can also suppress mutual entanglement of powder 3 at injection molding. As a result, resin 2 retains good flowability during injection molding, and thus thin diaphragm 1 can be achieved. Powder 3 can also be easily dispersed in resin 2 when kneading resin 2 and powder 3.

Furthermore, since powder 3 of single-crystal diamond has less unevenness than that of polycrystalline diamond, abrasion of kneading equipment, injection molding machine, and molds can be suppressed. Powder 3 unlikely hinders flowability of resin 2 at injection molding, compared to polycrystalline diamond. Accordingly, good productivity of diaphragm 1 can be achieved. In addition, since powder 3 is single-crystal diamond, it is more inexpensive than polycrystalline diamond.

The particle diameter of fine powder 3A in powder 3 is preferably not less than 30 μm and not greater than 60 μm. Fine powder 3A preferably accounts for 80% or more by volume ratio in the total volume of powder 3. In this case, powder with particle diameter less than 30 μm will not be contained exceeding 20%, and also powder 3 with particle diameter greater than 60 μm will not be contained exceeding 20%. If the particle diameter of powder 3 is small, mutual cohesion of powder 3 increases. This degrades flowability during injection molding. If the particle diameter of powder 3 is large, particles of powder 3 block each other in the molds and hinder flowability of resin 2 during injection molding, because the thickness of diaphragm 1 is generally about 0.2 mm to 0.5 mm. Accordingly, degradation of resin flowability during resin molding can be avoided and also degradation of uniform dispersion of powder 3 in resin 2 can be avoided if 80% or more of powder 3 has the particle diameter not less than 30 μm and not greater than 60 μm by volume ratio of fine powder 3A. Degradation of uniform thickness of diaphragm 1 can be avoided.

The above composition can further improve rigidity and sound velocity of diaphragm 1, and thus the reproduction band of diaphragm 1 can be further broadened. Distortion of diaphragm 1 can also be reduced. In addition, flowability of resin 2 is also unlikely suppressed during injection molding. Accordingly, thin diaphragm 1 can be achieved. Furthermore, variations in dimensions of diaphragm 1 can be reduced. Good productivity of diaphragm 1 is achieved even though it is thin. Diaphragm 1 with thickness of 0.2 mm to 0.3 mm can thus be easily fabricated, for example.

Powder particles with particle diameter of less than 1 μm have large cohesion. Accordingly, if fine powder 3A contains a lot of particles with particle diameter less than 1 μm, particles with particle diameter less than 1 μm aggregate by cohesion. This suppresses flowability of resin 2 during injection molding. Therefore, the particle diameter of fine powder 3A is preferably 1 μm or greater. An average particle diameter of fine powder 3A is preferably not less than 30 μm and not greater than 50 μm. This composition can suppress cohesion of fine powder 3A. Resin 2 can thus flow smoothly during injection molding. Diaphragm 1 can be therefore made thin.

A content of fine powder 3A in entire powder 3 is preferably not less than 90% by volume ratio in the total volume of powder 3. In this composition, single-crystal diamond with large particle diameter exceeding 60 μm in powder 3 will be less than 10%. As a result, resin 2 can flow smoothly during injection molding, and thus diaphragm 1 can be made thin.

The use of aforementioned diaphragm 1 in loudspeaker 30 shown in FIG. 2 enables loudspeaker 30 to expand its reproduction band. Distortion of sound output from loudspeaker 30 can thus be reduced. Accordingly, loudspeaker 30 can reproduce the sound source with fidelity.

Figure 4:
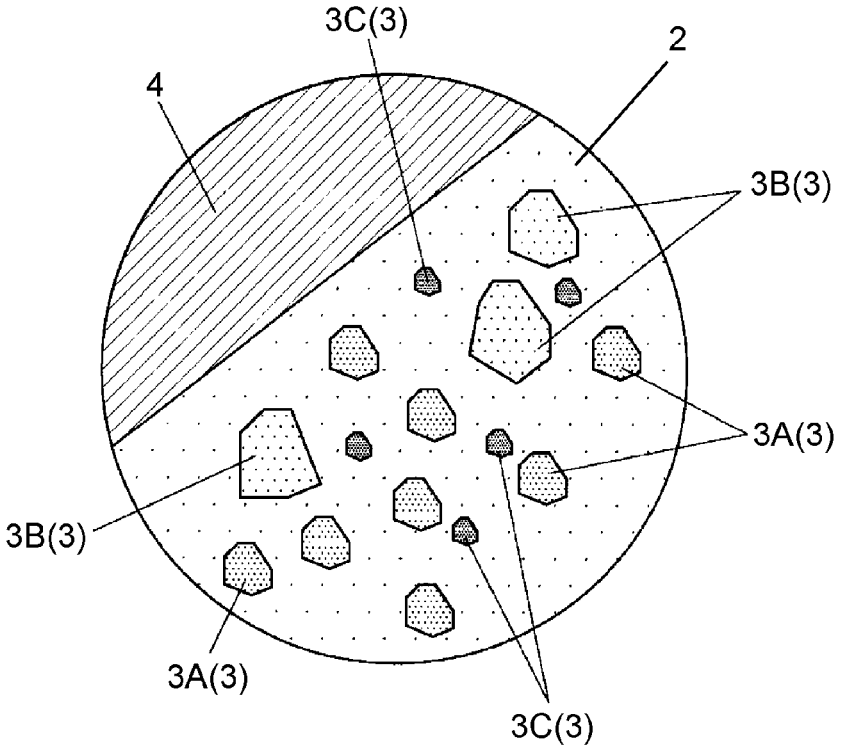
FIG. 4 is a magnified sectional view of a key part of another diaphragm for loudspeaker in accordance with the exemplary embodiment of the present invention.

Next, another diaphragm 4 for loudspeaker is described with reference to FIG. 4. FIG. 4 is a magnified sectional view of a key part of diaphragm 4 for loudspeaker in accordance with the exemplary embodiment. Diaphragm for loudspeaker 4 (hereafter referred to as "diaphragm 4") contains coarse powder 3B, which is second powder, and ultrafine powder 3C, which is third powder, in addition to fine powder 3A. Diaphragm 4 contains both coarse powder 3B and ultrafine powder 3C, but this is not limited. For example, diaphragm 4 may include either coarse powder 3B or ultrafine powder 3C.

A particle diameter of ultrafine powder 3C is preferably not less than 70 nm and not greater than 130 nm. This composition enables ultrafine powder 3C to enter among fine powder 3A or between resin and fine powder 3A to increase the strength by acting the role of a binder. However, in this case, the total volume of ultrafine powder 3C is preferably not greater than 10% in the total volume of powder 3. This composition achieves good flowability of resin 2 during injection molding even though powder 3 includes ultrafine powder 3C. Diaphragm 4 can thus be made thin. If the total volume of ultrafine powder 3C becomes greater than 10% in the total volume of powder 3, agglomeration tends to occur. Thus, defective dispersion may lead to defective appearance or degraded rigidity in thin molding.

A particle diameter of coarse powder 3B is preferably greater than 60 μm and not greater than 75 μm. A sum of the total volume of coarse powder 3B and the total volume of fine powder 3A preferably accounts for 99% or higher in the total volume of powder 3. In this composition, single-crystal diamond with large particle diameter exceeding 75 μm in powder 3 will be less than 1% at the maximum. As a result, resin 2 can flow smoothly during injection molding, and diaphragm 4 can be made thin.

The particle diameters described in the exemplary embodiment and their distribution are measured by a laser diffraction/scattering method using HELOS system by Sympatec, Inc.

If an additive with small variations in particle diameter and uniform shape is dispersed in resin 2, a frequency band of the diaphragm in which the peak and dip of sound pressure can be suppressed becomes narrow. Diaphragm 4 according to the exemplary embodiment is therefore formed using single-crystal diamond with a wide range of particle diameters. Diaphragm 4 thus has a small peak and dip of sound pressure in a broad frequency band.

The total weight of powder 3 in diaphragm 4 is preferably not less than 1 weight % and not greater than 30 weight % with respect to the weight of diaphragm 4. This composition suppresses an increase in weight of diaphragm 4 due to addition of powder 3, and improves the elastic modulus of diaphragm 4. Accordingly, the sound velocity of diaphragm 4 can be increased. Diaphragm 4 also has good productivity. In other words, if a mix ratio of powder 3 is less than 1 weight %, no significant effect can be achieved by mixing powder 3. Conversely, if a mix ratio of powder 3 is greater than 30 weight %, it requires long time for kneading powder 3 and resin 2. The weight of diaphragm 4 also becomes heavy and thus the sound velocity reduces.

Figure 5:
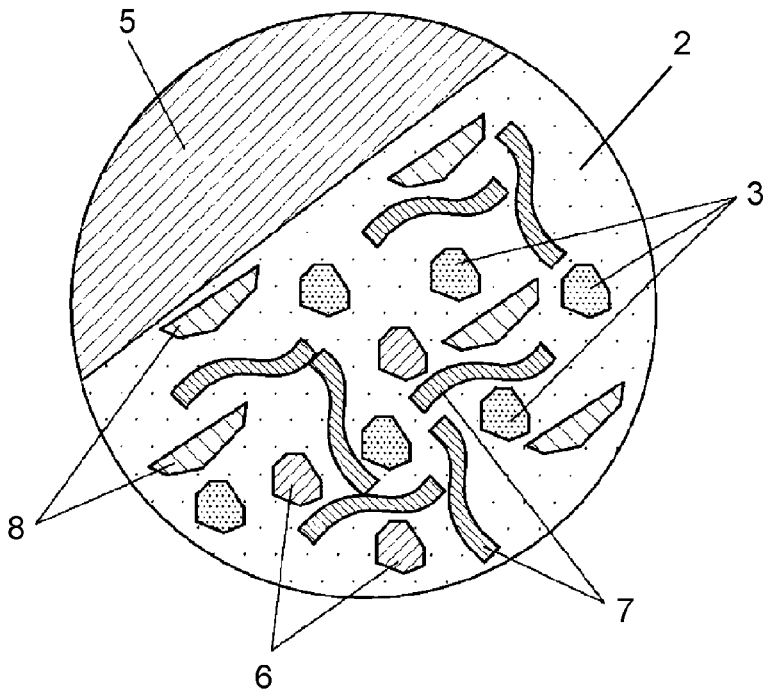
FIG. 5 is a magnified sectional view of a key part of still another diaphragm for loudspeaker in accordance with the exemplary embodiment of the present invention.

FIG. 5 is a magnified sectional view of still another diaphragm 5 for loudspeaker in accordance with the exemplary embodiment. Diaphragm 5 for loudspeaker (hereafter referred to as "diaphragm 5") contains resin 2, powder 3, bamboo charcoal 6, natural fiber 7, and reinforcing material 8, but not limited to this composition. Diaphragm 5 may contain one or more of bamboo charcoal 6, natural fiber 7, and reinforcing material 8, in addition to resin 2 and powder 3.

It is preferable that diaphragm 5 further includes bamboo charcoal 6. Bamboo charcoal 6 is also preferably powder, same as powder 3. Still more, bamboo charcoal 6 is preferably burned at not less than 600° C. and not greater than 800° C.

Bamboo charcoal 6 burned at 600° C. or higher has high rigidity. An elastic modulus of diaphragm 5 thus increases. In addition, bamboo charcoal 6 burned at 600° C. or higher is provided with numerous macropores and micropores. Diameters of macropores are within a range from about 10 μm to 40 μm. Diameters of micropores are within a range from about 1 nm to 20 nm. In other words, bamboo charcoal 6 has a shape with an uneven surface. Specific surface area of bamboo charcoal 6 is thus extremely large, and a contact area of bamboo charcoal 6 and resin 2 is therefore large. In addition, since resin 2 enters the macropores and the micropores of bamboo charcoal 6, the binding strength of resin 2 and bamboo charcoal 6 can be increased. Accordingly, the elastic modulus of diaphragm 5 can be increased.

On the other hand, powder 3 has a blocky shape and a smooth and cleavage surface. Accordingly, the binding strength of powder 3 and resin 2 is small. Since diaphragm 5 contains powder 3 and bamboo charcoal 6, a portion of powder 3 tends to fit into the uneven face of bamboo charcoal 6. In other words, bamboo charcoal 6 acts like a binder to increase the binding strength of powder 3 and resin 2. As a result, diaphragm 5 can be made further rigid. A specific gravity of bamboo charcoal 6 is smaller than a specific gravity of resin 2, and thus an increase in weight of diaphragm 5, due to addition of bamboo charcoal 6, can be suppressed.

For example, the specific surface area of bamboo charcoal burned at 400° C. is about 80 $m^2/g$. On the other hand, the specific surface area of bamboo charcoal burned at 600° C. is 370 $m^2/g$, which is significantly large. This is because micropores rapidly grow at around 600° C. The specific surface area of bamboo charcoal is maximized when burned at around 800° C. The specific surface area of bamboo charcoal burned at around 800° C. reaches about 725 $m^2/g$.

An electric resistance of charcoal burned at a high temperature is extremely small. Bamboo charcoal 6 burned at a temperature not greater than 800° C. is therefore used to suppress extreme reduction in electric resistance of diaphragm 5. As a result, a loss of audio signals passing tinsel wire 28A can be suppressed even if tinsel wire 28A shown in FIG. 2 is fixed onto diaphragm 5, for example.

By mixing bamboo charcoal 6 burned at a temperature within the aforementioned range, the elastic modulus and internal loss of diaphragm 5 can be improved. In particular, resonance in the middle and high frequency ranges can be suppressed, and thus the sound source can be reproduced with more fidelity. A black color of bamboo charcoal can also suppress the amount of colorant to be used, such as pigment.

Natural fiber 7 may be either wooden pulp or non-wooden pulp. Since diaphragm 5 includes powder 3 and natural fibers 7, natural fibers 7 entangle around powder 3. In other words, natural fibers 7 entangle so as to wrap around powder 3. Natural fiber 7 thus also acts as a binder to increase the binding strength of powder 3 and resin 2. As a result, rigidity of diaphragm 5 can be further increased.

If non-wooden pulp is used, bamboo fiber is preferably used as natural fiber 7. The bamboo fiber is light, and has higher elastic modulus than other pulp materials. The sound velocity of diaphragm 5 can thus be increased. In particular, sound output from diaphragm 5 containing bamboo fiber produces natural and bright tone.

Natural fiber 7 may also contain micro-fibrillated bamboo fiber with a partial fiber diameter of 5 μm or less. The microfibrillated bamboo fiber has thin and soft feathery fibers fuzzed on the surface of thick and rigid bamboo fiber. High elastic modulus of bamboo fiber is therefore retained, and thus the elastic modulus of diaphragm 5 can be increased. Furthermore, feathery fibers of microfibrillated bamboo fiber mutually entangle. This further increases the elastic modulus of diaphragm 5.

Since diaphragm 5 contains microfibrillated bamboo fiber and powder 3, particles with small particle diameter in powder 3 entangle with the feathery fibers. In other words, the microfibrillated bamboo fiber also acts as a binder to increase the binding strength of powder 3 and resin 2. As a result, rigidity of diaphragm 5 can be further increased.

Furthermore, natural fiber 7 may contain bamboo nanofiber. A diameter of nanofiber is not greater than 100 nm. Bamboo nanofibers tend to mutually entangle. Accordingly, diaphragm 5 containing bamboo nanofibers has further higher elastic modulus.

The growing period of bamboo is shorter than those of other general woods, and is one year or shorter. Accordingly, the use of fiber made of bamboo for diaphragm 5 has a small impact on the global environment. In particular, the use of a combination of two or more of bamboo charcoal, non-microfibrillated bamboo fiber, microfibrillated bamboo fiber, and bamboo nanofiber is effective for protecting forest resources and global environment. Rigidity of diaphragm 5 is also further increased by combining these materials appropriately.

The rigidity of powder 3 is high, and thus rigidity of diaphragm 5 can be increased by increasing the amount of powder 3. However, if a large amount of powder 3 is mixed, diaphragm 5 becomes heavier in weight. In addition, powder 3 has a small internal loss. Mixing of a large amount of powder 3 thus results in reducing an internal loss of diaphragm 5. In other words, there is a limitation to an amount of powder 3 to be mixed. To make up for this disadvantage of powder 3, reinforcing material 8 is preferably mixed with resin 2, in addition to powder 3.

By adding reinforcing material 8 to diaphragm 5, various characteristics of diaphragm 5 can be adjusted. Reinforcing material 8 is added for reinforcement of diaphragm 5, making a slight accent on sound, and adjustment of sound quality at certain frequencies by giving a peak to the sound pressure frequency characteristic. As reinforcing material 8, for example, mica, graphite, talc, calcium carbonate, clay, carbon fiber, or aramid fiber may be used.

If mica is used as reinforcing material 8, the elastic modulus of diaphragm 5 can be increased. If graphite is used as reinforcing material 8, both elastic modulus and internal loss of diaphragm 5 can be increased. If talc, calcium carbonate, or clay is used as reinforcing material 8, an internal loss of diaphragm 5 can be increased.

Chemical fibers can also be used as reinforcing material 8. As chemical fibers, aramid fiber or carbon fiber can be used. Chemical fiber is preferably used together with natural fiber 7. This composition enables chemical fiber and natural fiber 7 to entangle, and thus the elastic modulus of the diaphragm can be increased. Aramid fiber may also be used as reinforcing material 8. In this case, natural fiber 7 and aramid fiber are entangled, and thus an internal loss can be improved without reducing the elastic modulus of diaphragm 5. A heat resistance of diaphragm 5 can also be increased. If microfibrillated aramid fiber is used as reinforcing material 8, natural fiber 7 and reinforcing material 8 can be tightly entangled to further increase the elastic modulus and internal loss of diaphragm 5. If carbon fiber is used as reinforcing material 8, the rigidity of diaphragm 5 can be further strengthened, and also elastic modulus can be further increased.

Diamond powder may be treated with silane coupling agent in advance.

In general, a silane coupling agent having amino group is sufficient. However, a silane coupling agent having vinyl group, methacryloxyl group, or mercapto group may also be used, depending on a material and a resin which are combined as described above.

More specifically, examples of such a silane coupling agent includes vinyl trimethoxysilane, vinyl triethoxysilane, 3-methacryloxypropylmethyldimethoxysilane, 3-methacryloxypropyltrimethoxysilane, 3-methacryloxypropylmethyldiethoxysilane, 3-methacryloxypropyltriethoxysilane, 3-mercaptopropylmethyldimethoxysilane, and 3-mercaptopropyltrimethoxysilane.

Figure 6:
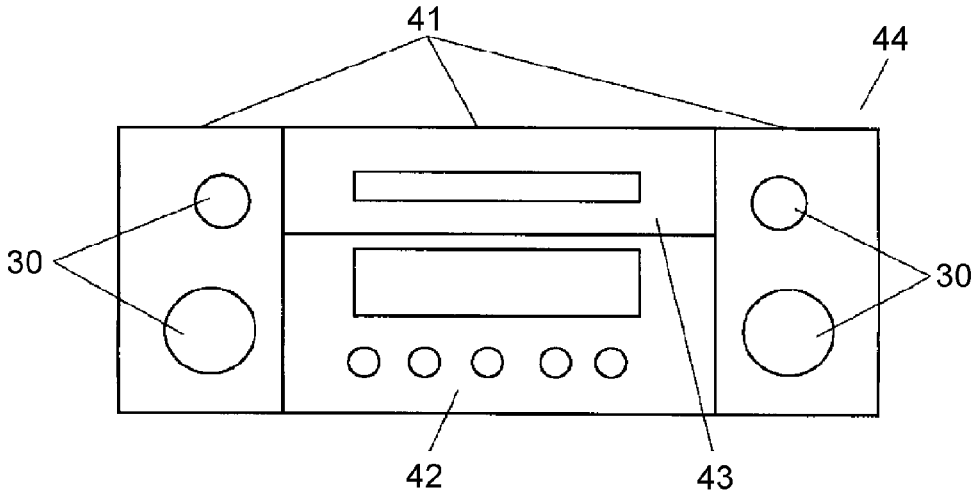
FIG. 6 is an external view of another electronic apparatus in accordance with the exemplary embodiment of the present invention.

FIG. 6 is an external view of mini stereo audio system 44, which is another electronic apparatus in accordance with the exemplary embodiment. Mini stereo audio system 44 includes enclosure 41, amplifier 42, control panel 43, and loudspeaker 30. Amplifier 42, control panel 43, and loudspeaker 30 are built in enclosure 41. Amplifier 42 includes an amplifier circuit for audio signals input to loudspeaker 30. Control panel 43, such as a player, outputs sound-source signals input to amplifier 42. With the above configuration, mini stereo audio system 44 achieves a broad reproduction band and can reproduce the original sound with fidelity.

An electronic apparatus is not limited to mini stereo audio system 44. For example, an electronic apparatus may be portable audio equipment or its charger system. Still more, an electronic apparatus may be video equipment such as liquid crystal television set and plasma display television set; information communication equipment such as a mobile phone; and computer-related equipment.

Figure 7:
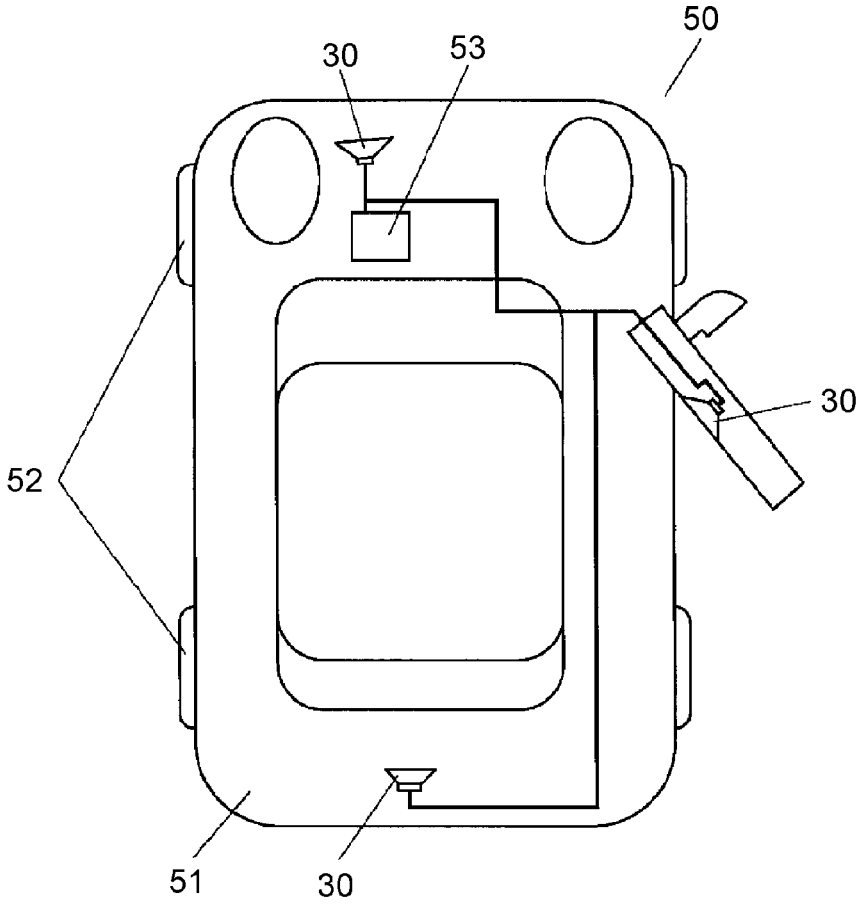
FIG. 7 is a conceptual diagram of a mobile apparatus in accordance with the exemplary embodiment of the present invention.

FIG. 7 is a conceptual diagram of a mobile apparatus in accordance with the exemplary embodiment. Mobile apparatus 50 is, for example, a vehicle. Mobile apparatus 50 includes main body 51, drive unit 52 installed in main body 51, amplifier 53 installed in main body 51, and loudspeaker 30 electrically connected to the output side of amplifier 53. Amplifier 53 may include sound source section 12 shown in FIG. 1.

Loudspeaker 30 is built, for example, in a door, rear tray, or front panel. Amplifier 53 and loudspeaker 30 may also be used as a part of a car navigation system or car audio system. A person in mobile apparatus 50 as configured above can enjoy sound reproducing the original sound with fidelity.

INDUSTRIAL APPLICABILITY

The diaphragm for loudspeaker, the loudspeaker, the electronic apparatus and the mobile apparatus are applicable in audio and video equipment, electronic apparatuses such as information and communication devices, and equipment for vehicle.

The invention claimed is:

1. A diaphragm for loudspeaker, comprising:
resin; and
powder of single-crystal diamond dispersed in the resin,
wherein the powder contains first powder that accounts for not less than 80% by volume ratio in a total volume of the powder, and a particle diameter of the first powder is in a range from 30 μm to 60 μm, inclusive, and
the powder further contains second powder in addition to the first powder, a total volume of the first powder and the second powder accounts for not less than 99% in a total volume of the powder, and a particle diameter of the second powder exceeds 60 μm but not greater than 75 μm.

2. The diaphragm for loudspeaker according to claim 1, wherein a content of the first powder in the powder is not less than 90% by volume ratio in the total volume of the powder.

3. The diaphragm for loudspeaker according to claim 2, wherein an average particle diameter of the first powder is in a range from 30 μm to 50 μm, inclusive.

4. A diaphragm for loudspeaker, comprising:
resin; and
powder of single-crystal diamond dispersed in the resin,
wherein the powder contains first powder that accounts for not less than 80% by volume ratio in a total volume of the powder, and a particle diameter of the first powder is in a range from 30 μm to 60 μm, inclusive, and
wherein the powder further contains second powder in addition to the first powder, and a particle diameter of the second powder is in a range from 70 nm to 130 nm, inclusive.

5. The diaphragm for loudspeaker according to claim 4, wherein a content of the second powder in the powder is not greater than 10% by volume ratio in the total volume of the powder.

6. The diaphragm for loudspeaker according to claim 1, wherein a percentage by weight of the powder in a total weight of the diaphragm is in a range from 1 weight percent to 30 weight percent, inclusive.

7. The diaphragm for loudspeaker according to claim 1, further comprising bamboo charcoal powder dispersed in the resin.

8. The diaphragm for loudspeaker according to claim 1, further comprising natural fiber dispersed in the resin.

9. The diaphragm for loudspeaker according to claim 8, wherein the natural fiber is bamboo fiber.

10. The diaphragm for loudspeaker according to claim 9, wherein the bamboo fiber contains microfibrillated bamboo fiber whose fiber diameter is partially not greater than 5 μm.

11. The diaphragm for loudspeaker according to claim 9, wherein the bamboo fiber contains fine bamboo fiber whose fiber diameter is not greater than 100 nm.

12. A loudspeaker comprising:
a frame;
the diaphragm for loudspeaker according to claim 1 having an outer periphery connected to the frame;
a voice coil connected to a center of the diaphragm; and
a magnetic circuit connected to the frame, and provided with a magnetic gap in which the voice coil is inserted.

13. An electronic apparatus comprising:
an enclosure;
the loudspeaker according to claim 12 built in the enclosure; and
an amplifier configured to output an audio signal to be supplied to the loudspeaker.

14. A mobile apparatus comprising:
a main body;
a drive unit installed in the main body;
an amplifier installed in the main body; and
the loudspeaker according to claim 12 electrically connected to an output side of the amplifier.

15. The diaphragm for loudspeaker according to claim 1, wherein the powder further contains third powder in addition to the second powder, and a particle diameter of the third powder is in a range from 70 nm to 130 nm, inclusive.

16. The diaphragm for loudspeaker according to claim 1, wherein the resin includes at least one selected from the group consisting of polypropylene, an olefin resin, liquid crystal polymer, engineering plastic and a polylactic resin.

17. A diaphragm for loudspeaker, comprising: resin; and
powder of single-crystal diamond dispersed in the resin,
wherein the powder contains first powder that accounts for not less than 80% by volume ratio in a total volume of the powder, and a particle diameter of the first powder is in a range from 30 μm to 60 μm, inclusive,
the powder further contains second powder in addition to the first powder, a total volume of the first powder and the second powder accounts for not less than 99% in a total volume of the powder, and a particle diameter of the second powder exceeds 60 μm but not greater than 75 μm, and
wherein the resin includes at least one selected from the group consisting of polypropylene, an olefin resin, liquid crystal polymer, engineering plastic and a polylactic resin.

* * * * *